US007735568B2

(12) United States Patent
Xu et al.

(10) Patent No.: US 7,735,568 B2
(45) Date of Patent: Jun. 15, 2010

(54) PACKER CUP SYSTEMS FOR USE INSIDE A WELLBORE

(75) Inventors: Zheng Rong Xu, Sugar Land, TX (US); Chad Lucas, Missouri City, TX (US); Richard Morrison, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 11/679,992

(22) Filed: Feb. 28, 2007

(65) Prior Publication Data

US 2007/0227746 A1 Oct. 4, 2007

Related U.S. Application Data

(63) Continuation-in-part of application No. 11/277,881, filed on Mar. 29, 2006.

(60) Provisional application No. 60/868,189, filed on Dec. 1, 2006.

(51) Int. Cl.
*E21B 33/12* (2006.01)

(52) U.S. Cl. ..... 166/387; 166/202; 166/187

(58) Field of Classification Search ..... 166/202, 166/387; 277/335, 337, 339–340
See application file for complete search history.

(56) References Cited

U.S. PATENT DOCUMENTS 2,325,556 A * 7/1943 Taylor, Jr. et al. ..... 92/241
2,925,128 A * 2/1960 Page, Jr. ..... 166/121
3,010,518 A * 11/1961 Harmon ..... 166/183
3,422,902 A * 1/1969 Bouchillon ..... 166/202
4,422,477 A * 12/1983 Wittman et al. ..... 138/89
4,438,933 A * 3/1984 Zimmerman ..... 277/337
4,921,046 A * 5/1990 Caskey ..... 166/170
5,117,910 A * 6/1992 Brandell et al. ..... 166/291
6,173,777 B1 * 1/2001 Mullins ..... 166/285
6,648,335 B1 * 11/2003 Ezell ..... 277/438
6,769,491 B2 * 8/2004 Zimmerman et al. ..... 166/387
6,827,150 B2 * 12/2004 Luke ..... 166/387
6,840,328 B2 * 1/2005 McKee et al. ..... 166/387
7,011,157 B2 * 3/2006 Costley et al. ..... 166/311
7,017,672 B2 * 3/2006 Owen, Sr. ..... 166/387
2003/0226663 A1 12/2003 Krueger et al.
2004/0026092 A1 * 2/2004 Divis et al. ..... 166/387
2004/0084187 A1 5/2004 Costley
2004/0134659 A1 * 7/2004 Hoffman et al. ..... 166/305.1
2004/0216892 A1 * 11/2004 Giroux et al. ..... 166/380
2005/0022986 A1 2/2005 Ring
2005/0045210 A1 * 3/2005 Baugh ..... 134/19

(Continued)

FOREIGN PATENT DOCUMENTS

GB 2406869 A * 4/2005

(Continued)

*Primary Examiner*—William P Neuder
*Assistant Examiner*—Cathleen R Hutchins
(74) *Attorney, Agent, or Firm*—Michael L. Flynn; David Hofman; Robin Nava

(57) ABSTRACT

The present invention provides a packer cup system for use inside a wellbore comprising a packer cup and a backup component coupled thereto. In one configuration, the backup component further comprises an angled support member and a rubber ring disposed between the angled support member and the packer cup. The support member is configured to facilitate uniform expansion of the rubber ring.

16 Claims, 8 Drawing Sheets

U.S. PATENT DOCUMENTS

| | | | | |
|---|---|---|---|---|
| 2005/0056434 | A1* | 3/2005 | Watson et al. | 166/384 |
| 2005/0098313 | A1* | 5/2005 | Atkins et al. | 166/202 |
| 2005/0103502 | A1 | 5/2005 | Watson | |
| 2006/0054330 | A1* | 3/2006 | Ring et al. | 166/380 |
| 2006/0090904 | A1* | 5/2006 | McGuire et al. | 166/387 |
| 2006/0096762 | A1 | 5/2006 | Brisco | |
| 2006/0102339 | A1* | 5/2006 | Cherewyk | 166/202 |
| 2006/0207760 | A1 | 9/2006 | Watson | |
| 2006/0219400 | A1 | 10/2006 | Xu | |
| 2006/0219415 | A1 | 10/2006 | Xu | |
| 2007/0056725 | A1* | 3/2007 | Lucas et al. | 166/179 |

FOREIGN PATENT DOCUMENTS

| | | | |
|---|---|---|---|
| RU | 1809218 | A1 | 4/1993 |
| RU | 2148700 | C1 | 5/2000 |
| RU | 2170332 | C2 | 7/2001 |

* cited by examiner

PACKER CUP SYSTEMS FOR USE INSIDE A WELLBORE

This application claims the benefit of U.S. Provisional Application No. 60/868,189, filed Dec. 1, 2006 and is a continuation-in-part of U.S. application Ser. No. 11/277,881, filed Mar. 29, 2006.

BACKGROUND

1. Field of the Invention

Implementations of various technologies described herein generally relate to packer cups for use in a wellbore.

2. Description of the Related Art

The following descriptions and examples are not admitted to be prior art by virtue of their inclusion within this section.

Packer cups are often used to straddle a perforated zone in a wellbore and divert treating fluid into the formation behind the casing. Packer cups are commonly used because they are simple to install and do not require complex mechanisms or moving parts to position them in the wellbore. Packer cups seal the casing since they are constructed to provide a larger diameter than the casing into which they are placed, thereby providing a slight nominal radial interference with the well bore casing. This interference, "swabbing," or "squeeze," creates a seal to isolate a geologic zone of interest and thereby diverts the treating fluid introduced into the casing into the formation.

Packer cups were developed originally to swab wells to start a well production. In recent years, packer cups have been used in fracturing or treatment operations carried out on coiled tubing or drill pipe. Such operations may require higher pressures and may require multiple sets of packer cups or isolations across various individual zones. At such high pressures, the rubber portion of the packer cups may deteriorate and extrude in the direction of the pressures, thereby jeopardizing the seal with the casing. Accordingly, a need exists in the industry for a system of packer cups that are capable of withstanding the high differential pressures encountered during fracturing or treatment operations.

SUMMARY

One embodiment of the present invention provides a packer cup system for use inside a wellbore comprising a packer cup and a backup component coupled thereto. The backup component further comprises a support member and a rubber ring disposed between the support member and the packer cup. The support member is configured to prevent the rubber ring from moving toward the support member. A tapered element is disposed between the rubber ring and the packer cup to facilitate uniform expansion of the rubber ring.

Still another embodiment of the present invention provides a packer cup system for use inside a wellbore comprising a packer cup and a backup component coupled thereto. The backup component further comprises a support member having an angled surface, a piston moveably disposed against the support member and a rubber ring disposed between the piston and the packer cup. The piston is configured to move between the support member and the rubber ring.

Yet another embodiment of the present invention provides a method of treating a formation. The method comprises the steps of isolating a zone with a packer cup having a backup system and pumping a treating fluid into the isolated zone. The backup system of the packer up comprises a support member and a rubber ring disposed between the support member and the packer cup, wherein the support member is configured to prevent the rubber ring from moving toward the support member. The backup system further comprises a tapered element disposed between the rubber ring and the packer cup.

The claimed subject matter is not limited to implementations that solve any or all of the noted disadvantages. Further, the summary section is provided to introduce a selection of concepts in a simplified form that are further described below in the detailed description section. The summary section is not intended to identify key features or essential features of the claimed subject matter, nor is it intended to be used to limit the scope of the claimed subject matter.

BRIEF DESCRIPTION OF THE DRAWINGS

Implementations of various technologies will hereafter be described with reference to the accompanying drawings. It should be understood, however, that the accompanying drawings illustrate only the various implementations described herein and are not meant to limit the scope of various technologies described herein.

DETAILED DESCRIPTION

As used here, the terms "up" and "down"; "upper" and "lower"; "upwardly" and downwardly"; "below" and "above"; and other similar terms indicating relative positions above or below a given point or element may be used in connection with some implementations of various technologies described herein. However, when applied to equipment and methods for use in wells that are deviated or horizontal, or when applied to equipment and methods that when arranged in a well are in a deviated or horizontal orientation, such terms may refer to a left to right, right to left, or other relationships as appropriate.

Figure 1:
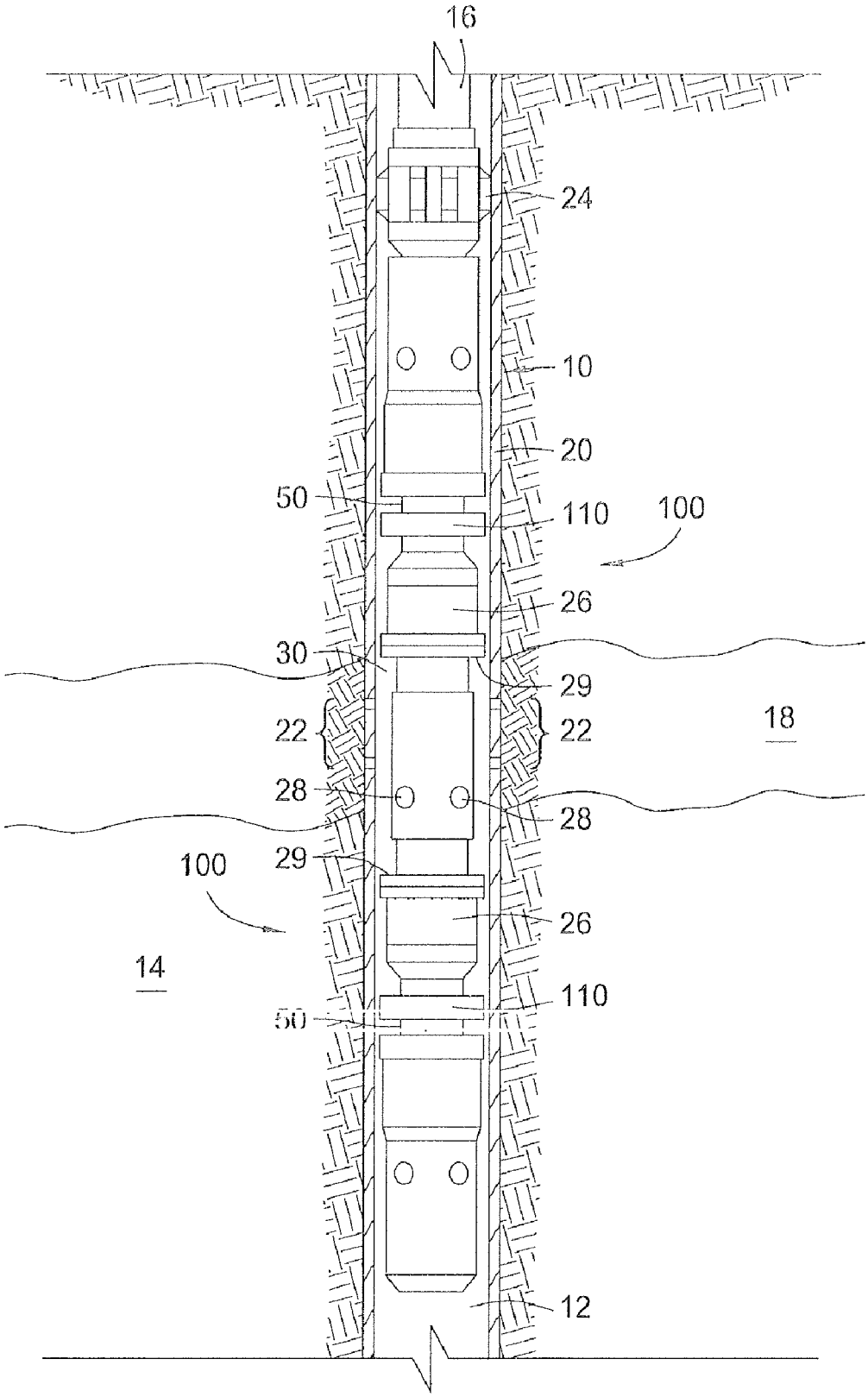
FIG. 1 illustrates a schematic diagram of a formation interval straddle tool that may be used in connection with one or more embodiments of the invention.

FIG. 1 illustrates a schematic diagram of a formation interval straddle tool 10 that may be used in connection with implementations of various technologies described herein. The straddle tool 10 is of the type typically employed for earth formation zone fracturing or other formation treating operations in wellbores. FIG. 1 illustrates the straddle tool 10 as being positioned within a cased wellbore 12, which has been drilled in an earth formation 14. The straddle tool 10 may be lowered into the wellbore 12 on a string of coiled or jointed tubing 16 to a position adjacent a selected zone 18 of the earth formation 14. The wellbore 12 may be cased with a casing 20, which has been perforated at the selected zone 18 by the firing of perforating shaped charges of a perforating gun or other perforating device, as illustrated by the perforations 22.

Once the straddle tool 10 is in position adjacent the selected formation zone 18, the straddle tool 10 may be operated from the earth's surface to deploy anchor slips 24 to lock itself firmly into the casing 20 in preparation for fracturing or treating the selected formation zone 18. The straddle tool 10 may further include one or more packer cup systems 100 disposed on a mandrel 50. Each packer cup system 100 may include a packer cup 26 and a backup component 110. When pressurized fracturing or treating fluid is pumped from the earth's surface through the string of coiled or jointed tubing 16 and the straddle tool 10 toward the formation zone 18, the pressure of fluid exiting the straddle tool 10 may force the packer cups 26 to engage the casing 20 at one or more treating ports 28. The open ends 29 of the cup packers 26 may be arranged to face each other and straddle an interval 30 of the wellbore 12 between the packer cups 26. Although FIG. 1 illustrates the straddle tool 10 without any other attachments, it should be understood that in some implementations the straddle tool may have other tools or components attached thereto, such as a pressure balance system, a slurry dump valve, a scraper and the like.

When the packer cups 26 have fully engaged the casing 20, the formation zone 18 and the straddled interval 30 between the packer cups 26 will be pressurized by the incoming fracturing or treating fluid. Upon completion of fracturing or treating of the formation zone 18, the pumping of fracturing or treating fluid from the earth's surface may be discontinued, and the straddle tool 10 may be operated to dump any excess fluid, thereby relieving the pressure in the straddled interval 30.

In general, the packer cups 26 may be configured to seal against extreme differential pressure. The packer cups 26 may also be flexible such that it may be run into a well without becoming stuck and durable so that high differential pressure may be held without extrusion or rupture. As such, the packer cups 26 may be constructed from strong and tear resistant rubber materials. Examples of such materials may include nitrile, VITON, hydrogenated nitrile, natural rubber, AFLAS, and urethane (or polyurethane).

Figure 2:
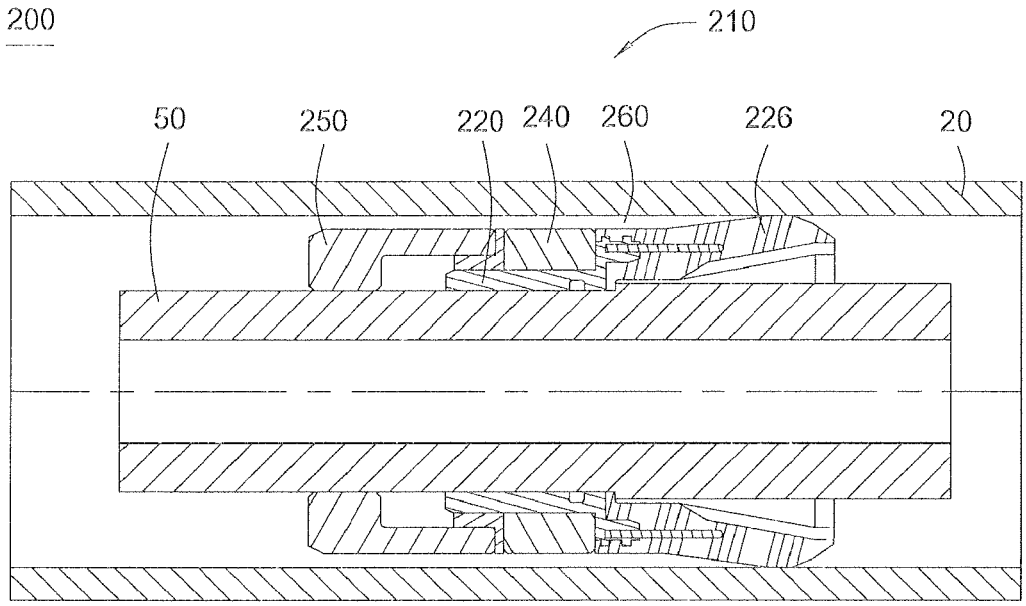
FIG. 2 illustrates a cross sectional view of a packer cup system in accordance with one implementation of various technologies described herein.

FIG. 2 illustrates a cross sectional view of a packer cup system 200 in accordance with one implementation of various technologies described herein. The packer cup system 200 may include a packer cup 226 having a metal support 220 attached thereto. Both the packer cup 226 and the metal support 220 may be coupled to the mandrel 50. In one implementation, the packer cup system 200 may include a backup component 210 having a rubber ring 240 coupled to the metal support 220. In another implementation, the rubber ring 240 may be supported by a support member 250 coupled to the mandrel 50. The rubber ring 240 may be made from strong and tear resistant rubber materials, such as nitrile, VITON, hydrogenated nitrile, natural rubber, AFLAS, urethane (or polyurethane), high DURO and the like. The support member 250 may be permanently coupled to the mandrel 50. It should be understood that in some embodiments, the support ring 240 can be coupled to the packer cup 226 by molding onto the packer cup 226 to form an integral component.

The backup component 210 may be activated as a differential pressure is applied across the packer cup 226. Such differential pressure may be caused by the difference between the pressure of the treatment fluid against the open ends 29 of the packer cup 226 and the pressure inside the annulus 260. This difference in pressure across the packer cup 226 may move the packer cup 226 along the mandrel 50 towards the lower pressure side, i.e., towards the left side of the packer cup 226 in FIG. 2. As a result of this movement, the rubber ring 240 may be compressed and radially expand toward the casing 20 to close the annular gap 260 between the packer cup 226 and the casing 20. In this manner, the backup component 210 may be used to prevent the packer cup 226 from extruding under pressure, thereby enabling the packer cup 226 to operate under a high differential pressure environment.

Figure 3:
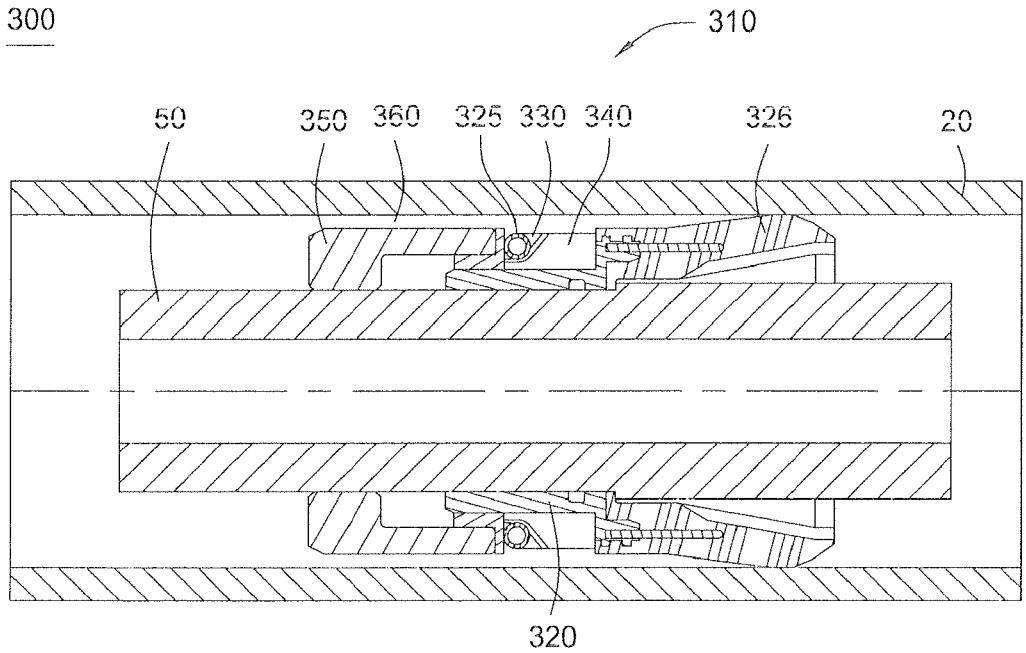
FIG. 3 illustrates a cross sectional view of a packer cup system in accordance with another implementation of various technologies described herein.

FIG. 3 illustrates a cross sectional view of a packer cup system 300 in accordance with another implementation of various technologies described herein. The packer cup system 300 may include a packer cup 326 having a metal support 320 attached thereto. Both the packer cup 326 and the metal support 320 may be coupled to the mandrel 50. In one implementation, a backup component 310 may be positioned to support the packer cup 326. The backup component 310 may include a support member 350 coupled to a rubber ring 340 having a helical spring 325 embedded along the circumference of the rubber ring 340. In one implementation, the helical spring 325 may be covered with a wire mesh 330, which may be configured to minimize the amount of rubber material entering into the helical spring 325 during its expansion. The helical spring 325 may be configured to be more elastic than the rubber ring 340. It should be understood that in some embodiment, the rubber ring 340 having the embedded helical spring 325 (with or without the wire mesh 330) can be coupled to the packer cup 326 by molding onto the packer cup 326 to form an integral component. As mentioned above, the support member 350 may be permanently coupled to the mandrel 50.

The backup component 310 may be activated by the differential pressure across the packer cup 326. This difference in pressure across the packer cup 326 may move the packer cup 326 along the mandrel 50 towards the lower pressure side, i.e., towards the left side of the packer cup 326 in FIG. 3. As a result of this movement, the rubber ring 340 may be compressed and the helical spring 325 may expand radially toward the casing 20 to close the annular gap 360 between the packer cup 326 and the casing 20. In this manner, the backup component 310 may be used to prevent the packer cup from extruding under pressure.

Figure 4:
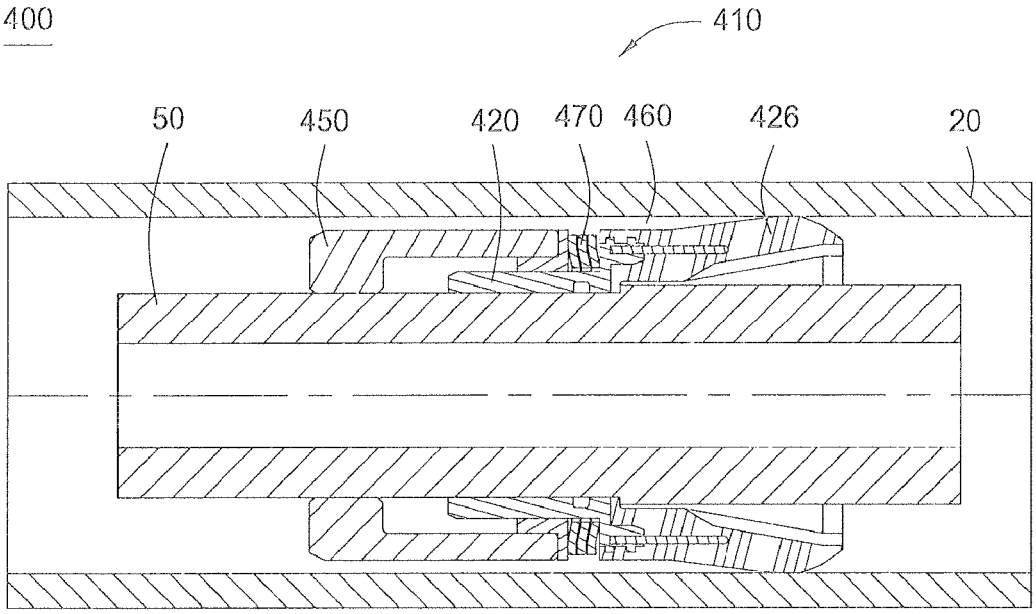
FIG. 4 illustrates a cross sectional view of a packer cup system in accordance with yet another implementation of various technologies described herein.

FIG. 4 illustrates a cross sectional view of a packer cup system 400 in accordance with yet another implementation of various technologies described herein. The packer cup system 400 may include a packer cup 426 having a metal support 420 attached thereto. Both the packer cup 426 and the metal support 420 may be coupled to the mandrel 50. In one implementation, a backup component 410 may be positioned to support the packer cup 426. The backup component 410 may include a support member 450 coupled to a wave spring 470. It should be understood that in some embodiment, the wave spring 470 can be coupled to the packer cup 426 by molding onto the packer cup 426 to form an integral component. The support member 450 may be permanently coupled to the mandrel 50.

The backup component 410 may be activated by the differential pressure across the packer cup 426. This difference in pressure across the packer cup 426 may move the packer cup 426 along the mandrel 50 towards the lower pressure side, i.e., towards the left side of the packer cup 426 in FIG. 4. As a result of this movement, the wave spring 470 may be compressed and expand radially toward the casing 20, i.e., its inside diameter (ID) and outside diameter (OD) may radially expand toward the casing 20, to close the annular gap 460 between the packer cup 426 and the casing 20. In this manner, the backup component 410 may be used to prevent the packer cup 426 from extruding under pressure.

Figure 5:
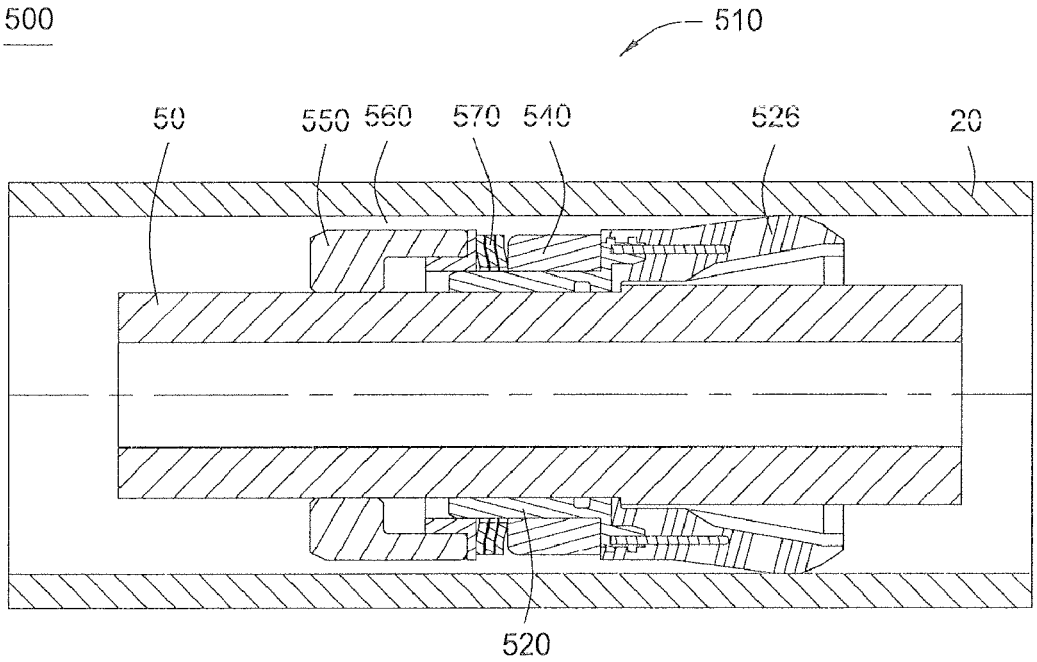
FIG. 5 illustrates a cross sectional view of a packer cup system in accordance with still another implementation of various technologies described herein.

FIG. 5 illustrates a cross sectional view of a packer cup system 500 in accordance with still another implementation of various technologies described herein. The packer cup system 500 may include a packer cup 526 having a metal support 520 attached thereto. Both the packer cup 526 and the metal support 520 may be coupled to the mandrel 50. In one implementation, a backup component 510 may be positioned to support the packer cup 526. The backup component 510 may include a support member 550 coupled to a wave spring 570 coupled to a rubber ring 540. It should be understood that the wave spring 570 and rubber ring 540 can be coupled to the packer cup 526 by molding onto packer cup 526 to form an integral component.

The backup component 510 may be activated by the differential pressure across the packer cup 526. This difference in pressure across the packer cup 526 may move the packer cup 526 along the mandrel 50 towards the lower pressure side, i.e., towards the left side of the packer cup 526 in FIG. 5. As a result of this movement, both the rubber ring 540 and the wave spring 570 may be compressed and cause the inside diameter (ID) and outside diameter (OD) of the wave spring 570 to expand radially toward the casing 20, thereby closing the annular gap 560 between the packer cup 526 and the casing 20. In this manner, the backup component 510 may be used to prevent the packer cup 526 from extruding under pressure.

Figure 6:
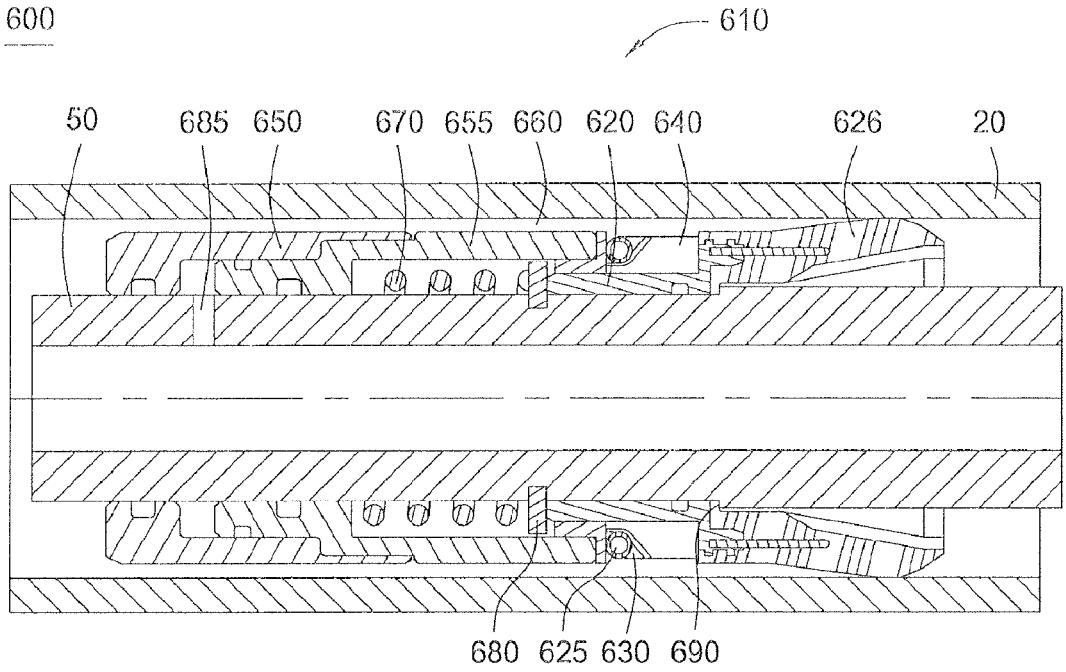
FIG. 6 illustrates a cross sectional view of a packer cup system in accordance with still yet another implementation of various technologies described herein.

FIG. 6 illustrates a cross sectional view of a packer cup system 600 in accordance with still yet another implementation of various technologies described herein. The packer cup system 600 may include a packer cup 626 having a metal support 620 attached thereto. Both the packer cup 626 and the metal support 620 may be coupled to the mandrel 50. In one implementation, a backup component 610 may be positioned to support the packer cup 626. The backup component 610 may include a support member 650 coupled to a mandrel 50. In one implementation, the support member 650 may be permanently coupled to the mandrel 50. The backup component 610 may further include a rubber ring 640 having a helical spring 625 embedded along the circumference of the rubber ring 640 and a piston 655 disposed between the support member 650 and the rubber ring 640. In one implementation, the helical spring 625 may be covered with a wire mesh 630, which may be configured to minimize the amount of rubber material entering into the helical spring 625 during its expansion. It should be understood that the rubber ring 640 having the embedded helical spring 625 (with or without the wire mesh 630) can be coupled to the packer cup 626 by molding onto the packer cup 626 to form an integral component.

In one implementation, the backup component 610 may be activated by fluid pressure flowing through a slot 685 to move the piston 655 against the rubber ring 640 having the helical spring 625 embedded therein such that both the helical spring 625 and rubber ring 640 may expand radially toward the casing 20, thereby closing the annular gap 660 between the packer cup 626 and the casing 20. The fluid pressure may be generated by the treatment or fracturing fluid flowing from the surface through the tubing 16.

The backup component 610 may further include a spring 670 configured to exert a predetermined amount of force against the piston 655. As such, the piston 655 may have to overcome this force before the piston 655 can press against the rubber ring 640 and cause the helical spring 625 to expand radially. In this manner, the backup component 610 may be activated only when the force generated by fluid pressure communicated through the slot 685 and acting on the piston 655 is greater than the amount of force exerted by the spring 670.

The backup component 610 may further include a holding pin 680 configured to prevent the packer cup 626 from moving toward the piston 655. A shoulder 690 may also be provided to prevent the packer cup 626 from moving away from the piston 655. As such, the packer cup 626 may be held stationary by the holding pin 680 and the shoulder 690. Implementations of various technologies described with reference to the packer cup system 600 may reduce the likelihood the backup component 610 from being activated during a run in-hole operation.

Figure 7:
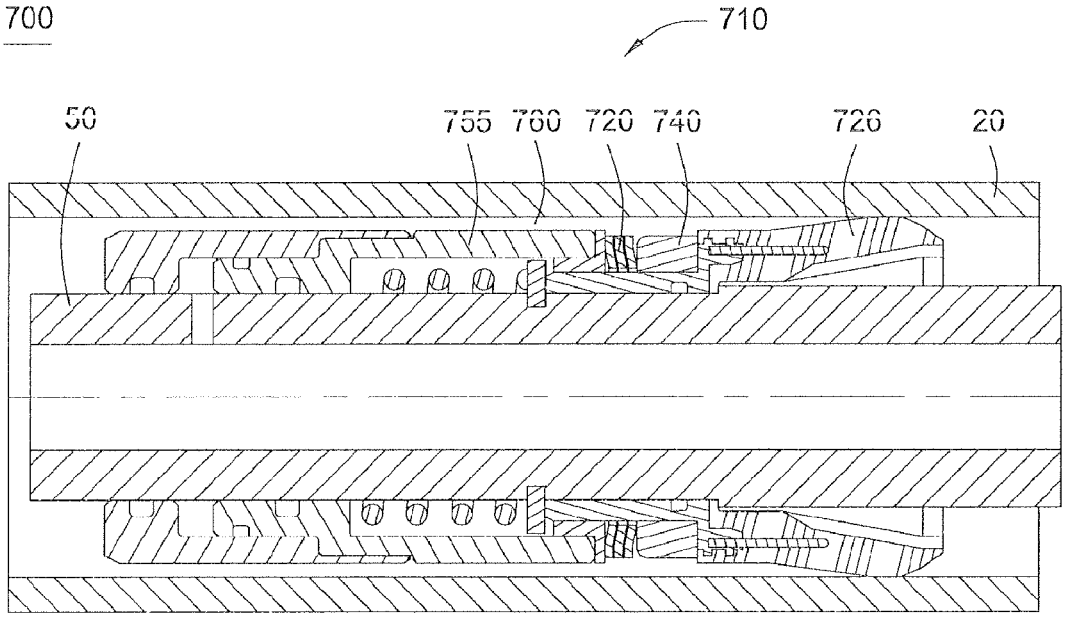
FIG. 7 illustrates a cross sectional view of a packer cup system in accordance with still yet another implementation of various technologies described herein.

FIG. 7 illustrates a cross sectional view of a packer cup system 700 in accordance with still yet another implementation of various technologies described herein. The packer cup system 700 may include the same or similar elements or components as the packer cup system 600, except that the rubber ring 640 and the helical spring 625 have been replaced with a wave spring 720 and a rubber ring 740 coupled thereto. Consequently, other details about those same or similar elements may be provided in the above paragraphs with reference to the packer cup system 600. When the backup component 710 is activated, the piston 755 presses against the wave spring 720 and the rubber ring 740, causing the inside diameter (ID) and outside diameter (OD) of the wave spring 720 to expand radially toward the casing 20, thereby closing the annular gap 760 between the packer cup 726 and the casing 20. In this manner, the backup component 710 may be activated by pressure applied from the surface to prevent the packer cup 726 from extruding under pressure. It should be understood that the wave spring 720 and rubber ring 740 can be coupled to the packer cup 726 by molding onto packer cup 726 to form an integral component.

Figure 8:
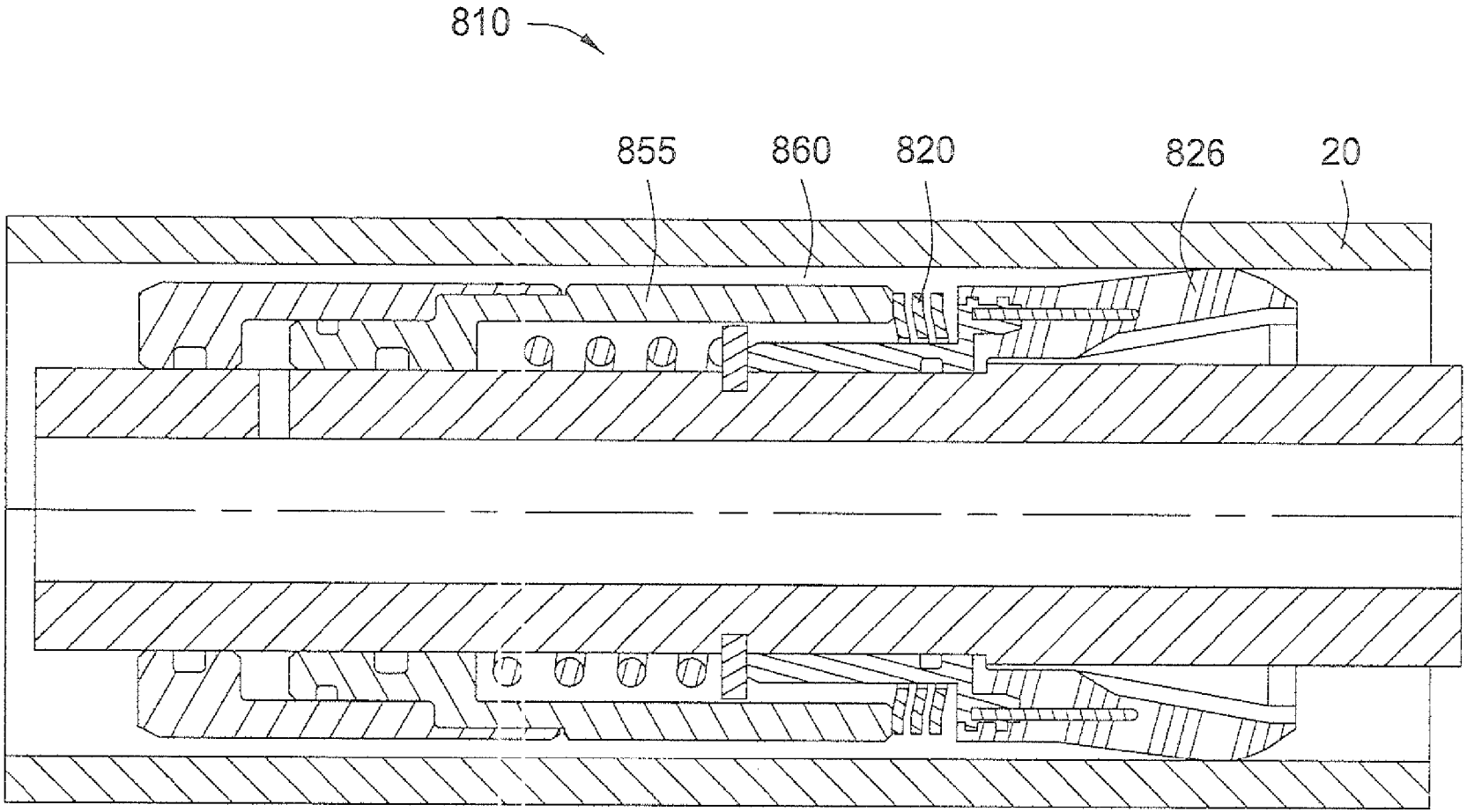
FIG. 8 illustrates a cross sectional view of a packer cup system in accordance with yet another implementation of various technologies described herein.

FIG. 8 illustrates a cross sectional view of a packer cup system 800 in accordance with yet another implementation of various technologies described herein. The packer cup system 800 may include the same or similar elements or components as the packer cup system 700 with the exception of the rubber ring 740. Consequently, other details about those same or similar elements may be provided in the above paragraphs with reference to the packer cup system 700. When the backup component 810 is activated, the piston 855 presses against the wave spring 820, causing the inside diameter (ID) and outside diameter (OD) of the wave spring 820 to expand radially against the casing 20, thereby closing the annular gap 860 between the packer cup 826 and the casing 20. In this manner, the backup component 810 may be activated by pressure applied from the surface to prevent the packer cup 826 from extruding under pressure.

As described with reference to FIGS. 9-16 below, alternate embodiments of the present invention further facilitate the uniform expansion of the rubber rings (240, 340, 540, 640, and 740). Such uniform and full expansion inside the wellbore is accomplished even at low pressures.

Although the alternate embodiments described with reference to FIGS. 9-16 have applicability to all of the previously described embodiments detailed in FIGS. 2-8, for simplicity of description, the alternate embodiments will be described with primary reference to FIG. 6. For example, the expansion element of the backup system (240, 340, 540, 640 and 740) will collectively be described with reference to the rubber ring 640 of FIG. 6 and the packer cups (226, 326, 526, 626 and 726) will be collectively be described with reference to the packer cup 626 of FIG. 6.

Figure 9:
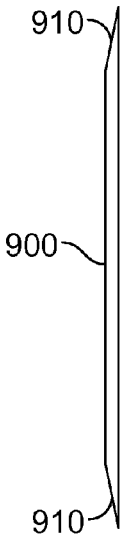
FIG. 9 illustrates an embodiment of a wedge shim of the present invention.
Figure 10:
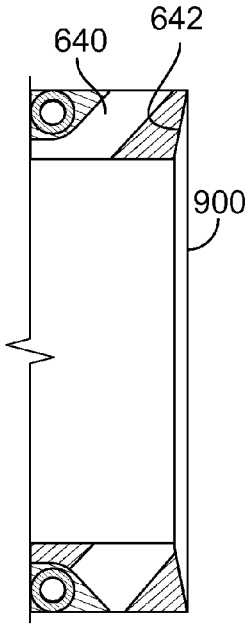
FIG. 10 illustrates an embodiment of the present invention having a wedge shim adjacent the rubber element.

FIG. 9 illustrates an embodiment of a wedge shim 900 having a tapered surface 910 that can be used to advantage by the present invention. For example, as shown in FIG. 10, the wedge shim 900 can be disposed between the rubber ring 640 and the packer cup 626 to facilitate expansion of the rubber ring 640. In the embodiment shown, the rubber ring 640 additionally comprises a chamfered surface 642 adapted to engage the angled surface 910 of the wedge shim 900.

Although the wedge shim 900 is illustrated as an element separate from the packer cup 626, it should be understood that in alternate embodiments, the wedge shim 900 can be integrated into the packer cup 626. It should further be understood that the term "wedge shim" is intended to encompass any element having a tapered surface that further facilitates uniform expansion of the rubber element 640.

Figure 11A:
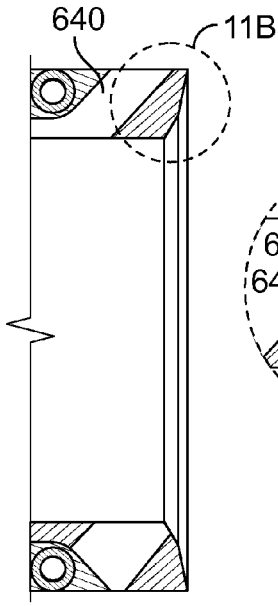
FIG. 11A is an enlarged view illustration of the chamfered surfaces of FIG. 11.
Figure 11B:
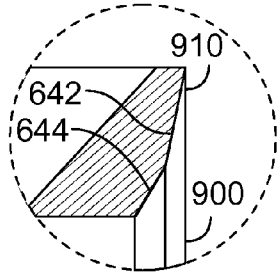
FIG. 11 illustrates an embodiment of a rubber element of the present invention having a chamfer at two distinctive angles.

FIGS. 11 and 11A illustrate another embodiment of the present invention having a wedge shim 900 disposed between the rubber ring 640 and the packer cup 626 to facilitate expansion of the rubber ring 640. As best described with reference to FIG. 11A, which is an enlarged view of the interface between the wedge shim 900 and the rubber ring 640, the rubber ring 640 has chamfers 642 and 644 at two distinct angles. The chamfers 642, 644 are adjacent a wedge shim 900 such as that illustrated in FIG. 9.

Figure 12:
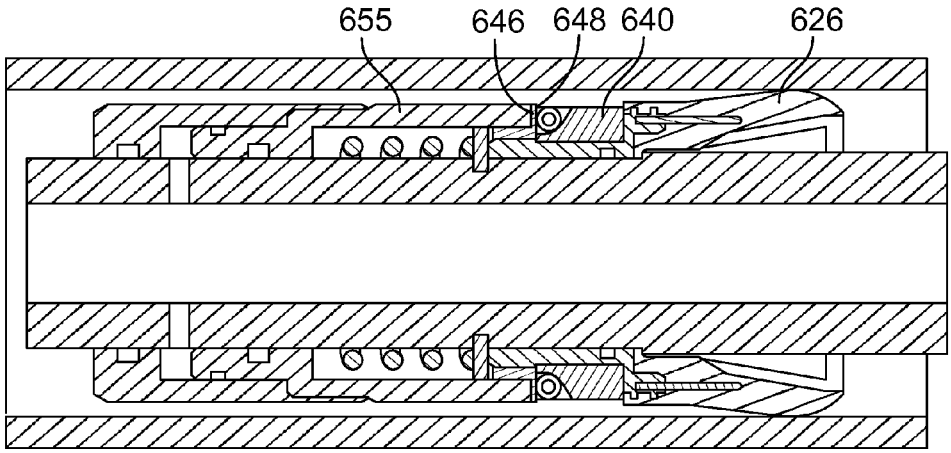
FIG. 12 illustrates an embodiment of the present invention having an angled support element.

FIG. 12 illustrates another embodiment of the present invention described with reference to the embodiment of the packer cup system depicted in FIG. 6. As described above, when activated the piston 655 exerts a force on the rubber ring 640 to force expansion. As shown, a support element 646 is disposed between the piston 655 and the rubber ring 640; thus the support element 646 transmits the force generated by the piston 655 to the rubber ring 640. In the embodiment of FIG. 12, the support element 646 further comprises an angled surface 648 that interacts with the rubber ring 640 to facilitate the uniform expansion of the rubber ring 640.

Although the support element 646 of FIG. 12 is shown as an element independent of the piston 655, it should be understood that in alternate embodiments, the support element 646 can be integral with the piston 655.

Figure 13:
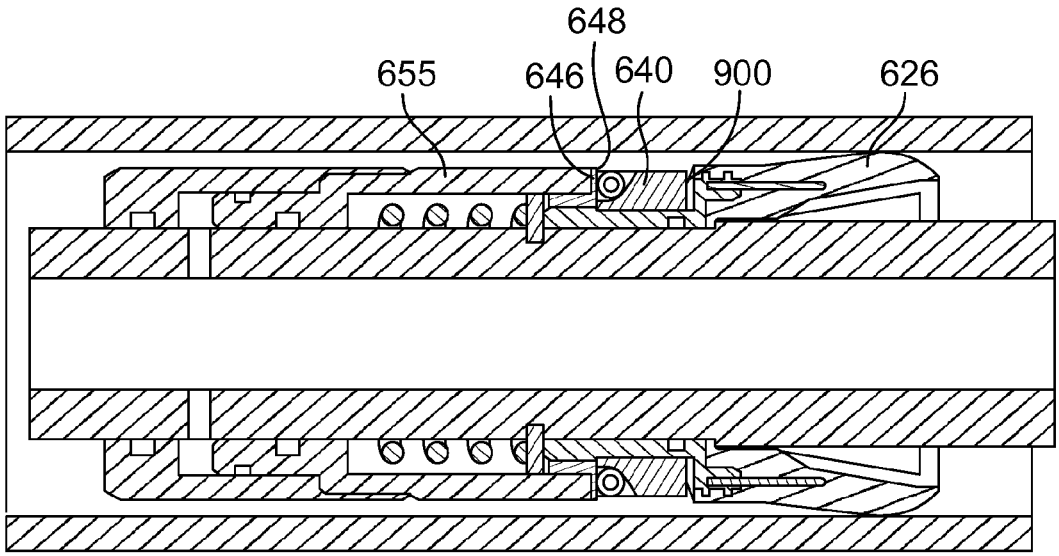
FIG. 13 illustrates an embodiment of the present invention having a wedge shim and an angled support member.

It should be understood that any combination of the above identified features can be provided while remaining within the scope of the present invention. One such example combination is illustrated in FIG. 13. Similar to FIG. 12, the embodiment of FIG. 13 includes a support element 646 having an angled surface 648 that interacts with the rubber ring 640 to facilitate the uniform expansion of the rubber ring 640. The embodiment illustrated in FIG. 13 further comprises a wedge shim 900 disposed between the rubber ring 640 and the packer cup 626.

Figure 14:
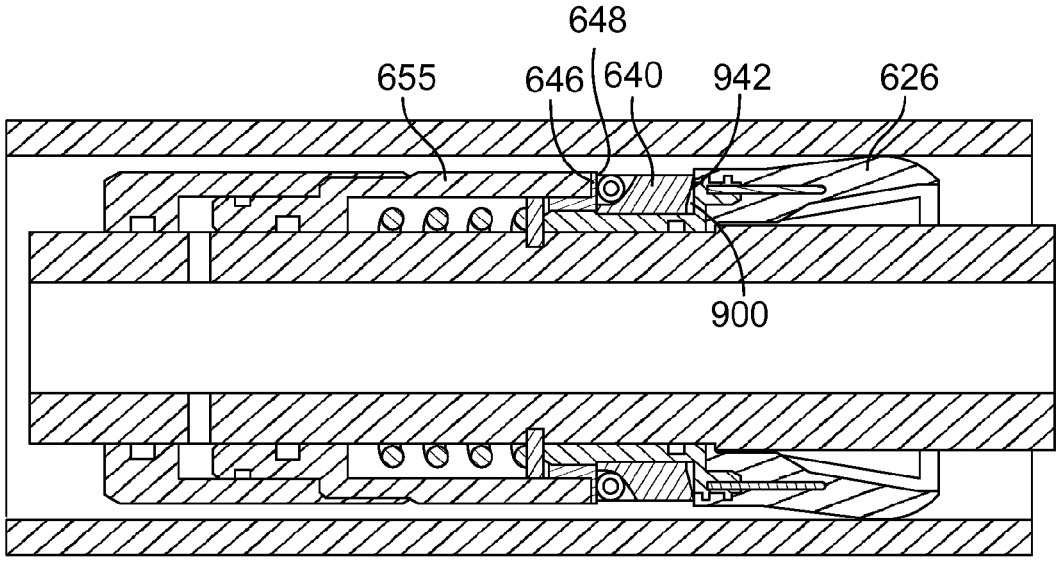
FIG. 14 illustrates an embodiment of the present invention having a wedge shim, a chamfered rubber element and an angled support member.

FIG. 14 illustrates yet another embodiment of the present invention. Similar to FIG. 13, the embodiment of FIG. 14 includes a support element 646 having an angled surface 648 that interacts with the rubber ring 640 to facilitate the uniform expansion of the rubber ring 640 and comprises a wedge shim 900 disposed between the rubber ring 640 and the packer cup 626. The embodiment illustrated in FIG. 14 further comprises a chamfered surface 642 on the rubber ring 640 adapted for engagement with the wedge shim 900.

Figure 15:
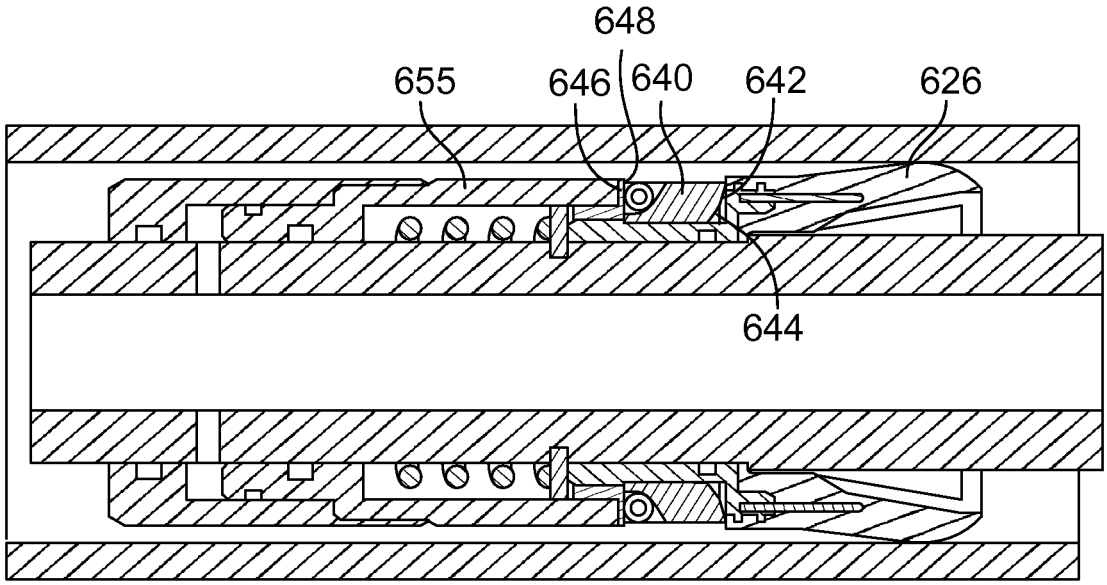
FIG. 15 illustrates an embodiment of the present invention having a wedge shim, a double chamfered rubber element and an angled support member.

FIG. 15 illustrates still another embodiment of the present invention. Similar to FIG. 14, the embodiment of FIG. 15 comprises a support element 646 having an angled surface 648 that interacts with the rubber ring 640 to facilitate the uniform expansion of the rubber ring 640, a wedge shim 900 disposed between the rubber ring 640 and the packer cup 626, and a chamfered surface on the rubber ring 640 adapted for engagement with the wedge shim 900. In the embodiment illustrated in FIG. 15, however, the chamfered surface of the rubber ring 640 comprises two chamfers 642, 644 at distinct angles.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A packer cup system for use inside a wellborn, comprising:

a packer cup disposed on an outside diameter of a mandrel for sealing between the outside diameter of the mandrel and the wellbore, the mandrel in fluid communication with a source of fluid from the earth's surface and operable to allow fluid to flow from the surface through the mandrel and beyond the packer cup;

a backup component coupled to the packer cup, wherein the backup component comprises a support member and a rubber ring disposed between the support member and the packer cup, wherein the support member is configured to prevent the rubber ring from moving toward the support member; and a tapered element comprising a wedge shim disposed between the rubber ring and the packer cup, wherein the rubber ring has a chamfer at two distinctive angles on adjacent surfaces for engaging with the wedge shim.

2. The packer cup system of claim 1, wherein the wedge shim is integral to the packer cup.

3. The packer cup system of claim 1, wherein the rubber ring further comprises a helical spring circumferentially embedded around the rubber ring.

4. The packer cup system of claim 3, wherein the helical spring is covered by a wire mesh.

5. A packer cup system for use inside a wellbore formed in an earth formation, comprising:

a packer cup disposed on an outside diameter of a mandrel for sealing between the outside diameter of the mandrel and the wellbore, the mandrel in fluid communication with a source of fluid from the earth's surface and operable to allow fluid to flow from the surface through the mandrel and beyond the packer cup; and a backup component coupled to the packer cup, wherein the backup component comprises:

a support member comprising an angled surface;

a piston moveably disposed against the support member; and a rubber ring disposed between the piston and the packer cup, wherein the piston is configured to move between the support member and the rubber ring, and wherein the angled surface facilitates the uniform expansion of the rubber ring when the piston exerts a force on the rubber ring.

6. The packer cup system of claim 5, wherein the rubber ring comprises a helical spring circumferentially embedded around the rubber ring.

7. The packer cup system of claim 6, wherein the helical spring is covered by a wire mesh.

8. The packer cup system of claim 5, further comprising a wedge shim disposed between the rubber ring and the packer cup.

9. The packer cup system of claim 8, wherein the rubber ring further comprises a chamfered surface adapted for engagement with the wedge shim.

10. The packer cup system of claim 5, wherein the piston is in fluid communication with an interior of the mandrel.

11. A method of treating a formation, comprising:

isolating a zone with a packer cup disposed on an outside diameter of a mandrel for sealing between the outside diameter of the mandrel and the wellbore, the mandrel in fluid communication with a source of fluid from the earth's surface and operable to allow fluid to flow from the surface through the mandrel and beyond the packer cup, the mandrel having a backup system comprising:

a support member and a rubber ring disposed between the support member and the packer cup, wherein the support member is configured to prevent the rubber ring from moving toward the support member;

a piston moveably disposed against the support member, the rubber ring disposed between piston and the packer cup, wherein the piston is configured to move between the support member and the rubber ring; and a tapered element disposed between the rubber ring and the packer cup; and pumping a treating fluid into the isolated zone.

12. The method of claim 11, further comprising:

conveying the packer cup with coiled tubing.

13. The method of claim 11, wherein the treating fluid is pumped through coiled tubing.

14. The method of claim 11, wherein the rubber ring has a chamfer at two distinctive angles on adjacent surfaces for engaging the wedge shim.

15. The method of claim 11, wherein the piston is in fluid communication with an interior of the mandrel.

16. The method of claim 15, wherein the piston is actuated by the treating fluid.

* * * * *